US010248060B2

(12) United States Patent
Yagi

(10) Patent No.: US 10,248,060 B2
(45) Date of Patent: Apr. 2, 2019

(54) FIXING DEVICE INCLUDING A FRICTION REDUCING SHEET AND A HEAT EQUALIZING SHEET AND IMAGE FORMING APPARATUS

(71) Applicant: KONICA MINOLTA, INC., Chiyoda-ku, Tokyo (JP)

(72) Inventor: Masataka Yagi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/009,265

(22) Filed: Jun. 15, 2018

(65) Prior Publication Data

US 2018/0364625 A1 Dec. 20, 2018

(30) Foreign Application Priority Data

Jun. 20, 2017 (JP) ..... 2017-120753

(51) Int. Cl.
*G03G 15/20* (2006.01)

(52) U.S. Cl.
CPC ..... *G03G 15/2053* (2013.01)

(58) Field of Classification Search
CPC ..... G03G 15/2025; G03G 15/2053
USPC ..... 399/329
See application file for complete search history.

(56) References Cited

U.S. PATENT DOCUMENTS 9,152,106 B2 * 10/2015 Yamaguchi et al. ..... G03G 15/2053
9,804,546 B2 * 10/2017 Saito et al. ..... G03G 15/2053
10,067,449 B2 * 9/2018 Matsuda et al. ... G03G 15/2053

FOREIGN PATENT DOCUMENTS

JP 2016-85384 A 5/2016
JP 2016-110020 A 6/2016
JP 2016-114743 A 6/2016

* cited by examiner

*Primary Examiner* — William J Royer
(74) *Attorney, Agent, or Firm* — Buchanan Ingersoll & Rooney PC

(57) ABSTRACT

A fixing device includes: a fixing belt that is endless and rotatable; a heating member that heats the fixing belt; a pressure member that is rotatable and presses the fixing belt from outside; a pad member that forms a fixing nip by sandwiching the fixing belt with the pressure member; a support member that supports the pad member; a friction reducing sheet that is provided between the fixing belt and the pad member and reduces friction with the fixing belt; and a heat equalizing sheet that is provided between the friction reducing sheet and the pad member and heats the fixing belt at the fixing nip uniformly in a width direction of a paper sheet passing through the fixing nip.

15 Claims, 9 Drawing Sheets

FIXING DEVICE INCLUDING A FRICTION REDUCING SHEET AND A HEAT EQUALIZING SHEET AND IMAGE FORMING APPARATUS

The entire disclosure of Japanese patent Application No. 2017-120753, filed on Jun. 20, 2017, is incorporated herein by reference in its entirety.

BACKGROUND

Technological Field

The present invention relates to a fixing device and an image forming apparatus.

Description of the Related Art

In general, an image forming apparatus (printer, copier, facsimile, etc.) using an electrophotographic process technique irradiates (exposes) a charged photosensitive drum (image carrier) with laser light based on image data to form an electrostatic latent image. Then, toner is supplied from a developing device onto the photosensitive drum on which the electrostatic latent image has been formed so that the electrostatic latent image is visualized and a toner image is formed. Further, after the formed toner image is directly or indirectly transferred to a paper sheet, the paper sheet is heated and pressurized at a fixing nip so that the toner image is fixed and formed on the paper sheet.

In recent years, an image forming apparatus, in particular a fixing device, has been undergoing size reduction from the viewpoint of improvement of energy saving performance and cost reduction. While the size of the fixing device is being reduced, as a configuration of the fixing device, the one using a fixing pad is becoming a mainstream. However, when the fixing device using a fixing pad is used, there may be a problem that torque increases by frictional resistance between an inner peripheral surface of a fixing belt and a pad member.

When the torque increases, problems of an increase in size of a drive motor and an increase in power consumption are likely to occur. Moreover, a surface of a pressure roller to be rotationally driven and a surface of the fixing belt to be rotated following the pressure roller rub against each other, whereby wear and deterioration of the pressure roller and the fixing belt may be accelerated.

In order to solve the above-described problem of the torque increase, for example, there is disclosed a technique for applying a lubricant to an inner surface of a fixing belt. For example, JP 2016-85384 A discloses a technique for controlling a coating amount of a lubricant applied to an inner surface of a fixing belt. However, when the technique for applying the lubricant to the fixing belt is employed, a mechanism for controlling the coating amount of the lubricant is required so that a configuration becomes complex.

In view of the above, JP 2016-110020 A discloses a technique with which a woven fabric sliding sheet is disposed between a fixing belt and a pad member so that the problem of the torque increase is overcome without using the lubricant. With this technique being employed, the above-described problem can be solved by using the sliding sheet having a low friction coefficient so that a configuration can be simplified.

However, since a sliding sheet is commonly made of a fluorine-based resin material, there is a disadvantage that a thermal conductivity is low. Accordingly, when a sliding sheet is used, a heat transfer amount in an axial direction across a fixing nip is significantly small. When a small size paper sheet passes through the fixing nip, for example, a problem of a remarkable temperature increase in a non-paper-passing area within the fixing nip is likely to occur.

In view of the above, for example, JP 2016-114743 A discloses a technique with which a heat equalizing member is disposed inside a sliding sheet so that a thermal conductance in an axial direction across a fixing nip is improved. This configuration includes a solid pad member, a solid first heat equalizing member, and an elastic second heat equalizing member. The second heat equalizing member is disposed between the pad member and the first heat equalizing member in such a manner that contact stability between the pad member and the first heat equalizing member is maintained.

However, in the configuration described in JP 2016-114743 A, the pad member and the first heat equalizing member, both of which are solid and highly rigid, are secured to each other while a temperature of the fixing nip becomes high, whereby the pad member and the first heat equalizing member deform due to a difference in a thermal expansion amount therebetween. When the pad member and the first heat equalizing member deform, a shape of the fixing nip changes, whereby a problem that a width of the fixing nip becomes non-uniform may be caused.

SUMMARY

An object of the present invention is to provide a fixing device and an image forming apparatus capable of improving thermal uniformity and slidability in a fixing nip while a width of the fixing nip is kept uniform.

To achieve the abovementioned object, according to an aspect of the present invention, a fixing device reflecting one aspect of the present invention comprises: a fixing belt that is endless and rotatable; a heating member that heats the fixing belt; a pressure member that is rotatable and presses the fixing belt from outside; a pad member that forms a fixing nip by sandwiching the fixing belt with the pressure member; a support member that supports the pad member; a friction reducing sheet that is provided between the fixing belt and the pad member and reduces friction with the fixing belt; and a heat equalizing sheet that is provided between the friction reducing sheet and the pad member and heats the fixing belt at the fixing nip uniformly in a width direction of a paper sheet passing through the fixing nip.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
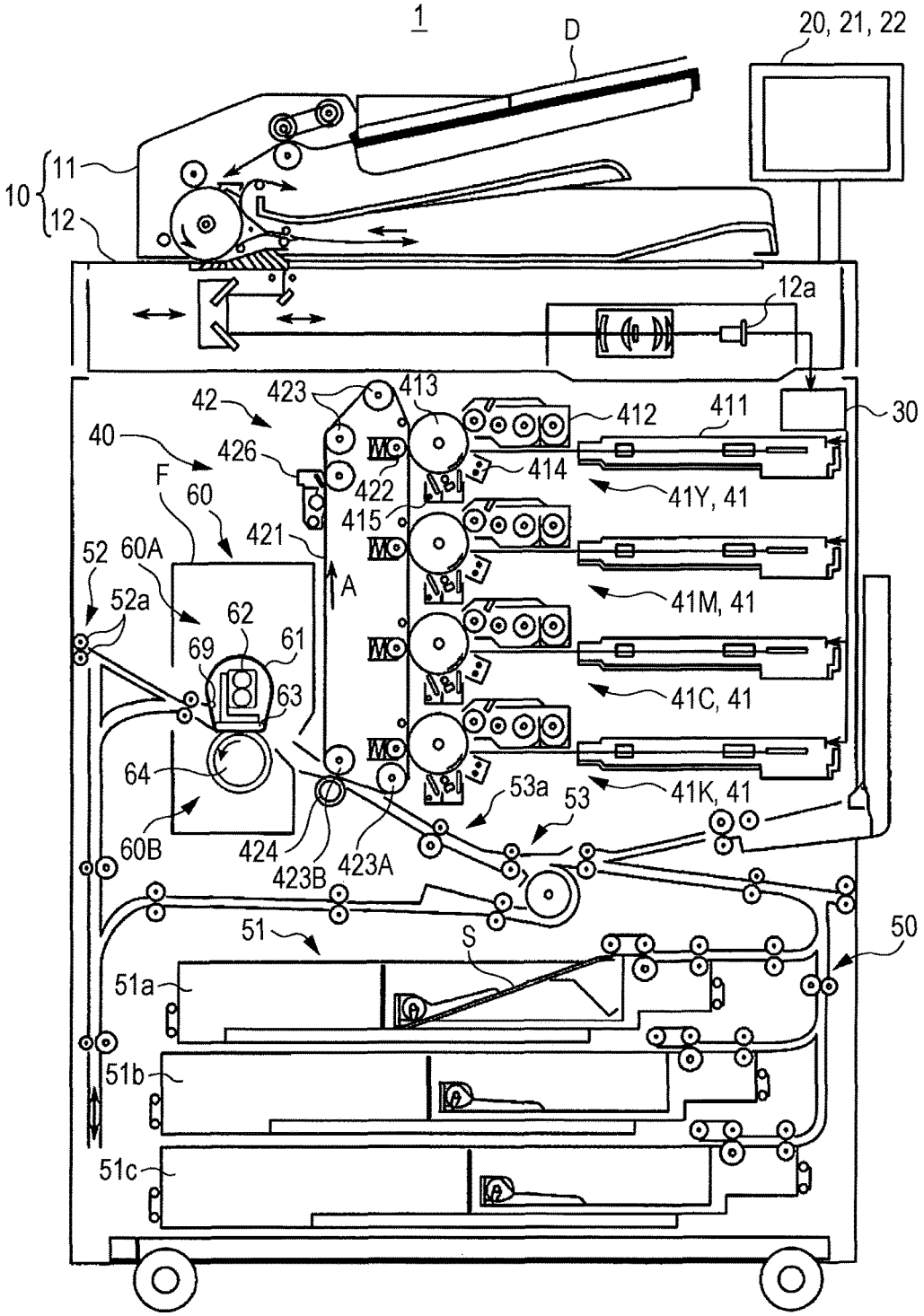
FIG. 1 is a diagram schematically illustrating an overall configuration of an image forming apparatus according to the present embodiment.
Figure 2:
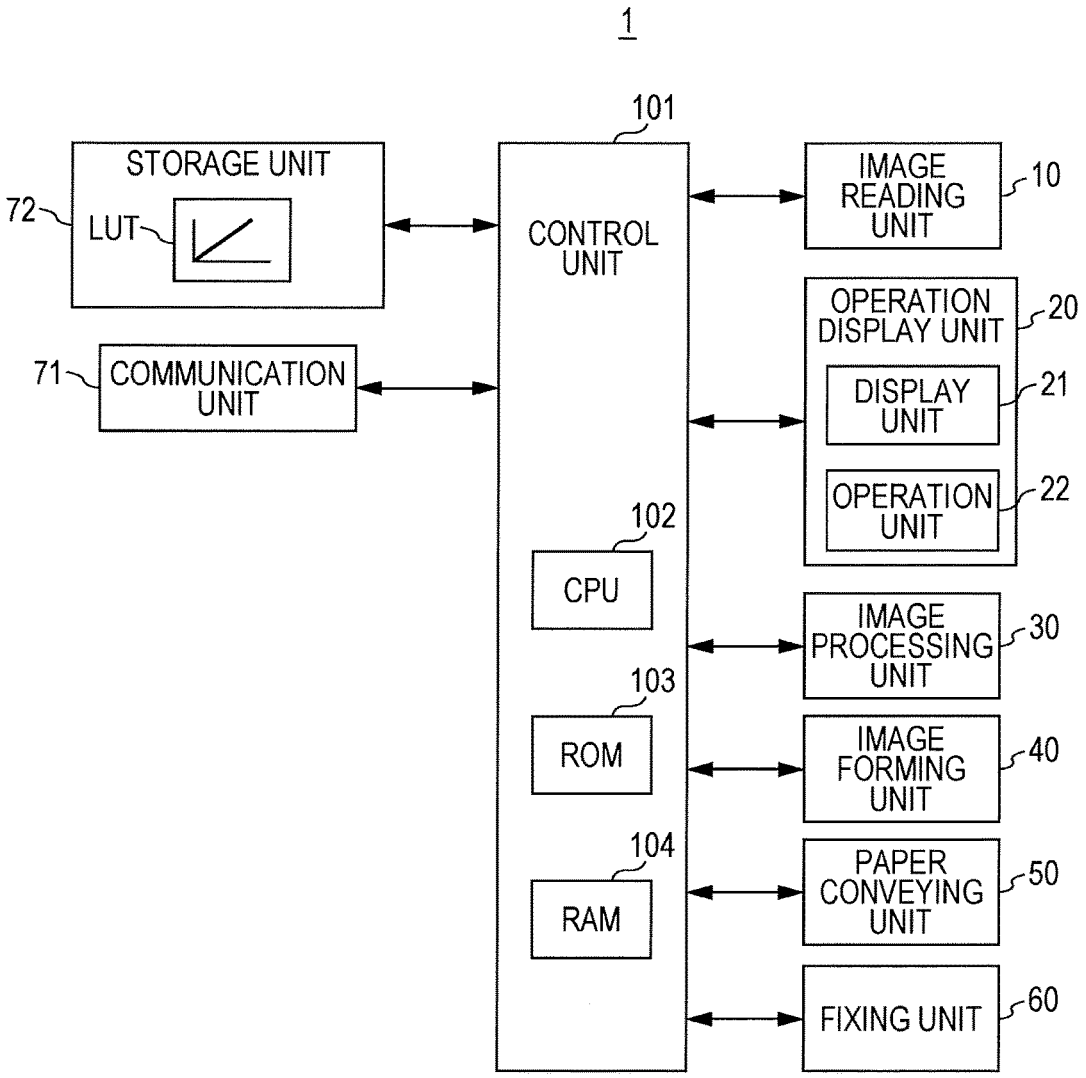
FIG. 2 is a diagram illustrating a main part of a control system of the image forming apparatus according to the present embodiment.

Hereinafter, one or more embodiments of the present invention will be described in detail with reference to the drawings. However, the scope of the invention is not limited to the disclosed embodiments. FIG. 1 is a diagram schematically illustrating an overall configuration of an image forming apparatus 1 according to the present embodiment. FIG. 2 is a diagram illustrating a main part of a control system of the image forming apparatus 1 according to the present embodiment.

As illustrated in FIG. 1, the image forming apparatus 1 is a color image forming apparatus of an intermediate transfer system, which uses an electrophotographic process technique. That is, the image forming apparatus 1 primarily transfers toner images of respective colors of yellow (Y), magenta (M), cyan (C), and black (K) formed on a photosensitive drum 413 onto an intermediate transfer belt 421, superposes the toner images of four colors on the intermediate transfer belt 421, and secondarily transfers the superposed toner image onto a paper sheet S sent out from paper feed tray units 51*a* to 51*c*, thereby forming an image.

Further, the image forming apparatus 1 employs a tandem system in which the photosensitive drums 413 corresponding to the four colors Y, M, C, and K are arranged in series in a traveling direction of the intermediate transfer belt 421, and the toner images of respective colors are sequentially transferred to the intermediate transfer belt 421 through a single procedure.

As illustrated in FIG. 2, the image forming apparatus 1 includes an image reading unit 10, an operation display unit 20, an image processing unit 30, an image forming unit 40, a paper conveying unit 50, a fixing unit 60, and a control unit 101. The fixing unit 60 corresponds to the "fixing device" of the present invention.

The control unit 101 includes a central processing unit (CPU) 102, a read only memory (ROM) 103, a random access memory (RAM) 104, and the like. The CPU 102 reads, from the ROM 103, a program corresponding to processing content, and the read program is loaded to the RAM 104. The CPU 102 centrally controls operations of each block of the image forming apparatus 1 and the like by cooperating with the loaded program. At this time, various data stored in a storage unit 72 is referred to. The storage unit 72 includes, for example, a non-volatile semiconductor memory (what is called flash memory) or a hard disk drive.

The control unit 101 transmits/receives, via a communication unit 71, various data to/from an external device (personal computer, for example) connected to a communication network such as a local area network (LAN) or a wide area network (WAN). The control unit 101 receives, for example, image data (input image data) transmitted from the external device, and performs control such that an image is formed on the paper sheet S on the basis of the received image data. The communication unit 71 includes, for example, a communication control card such as a LAN card.

As illustrated in FIG. 1, the image reading unit 10 includes an automatic document feeding device 11 called an auto document feeder (ADF), a document image scanning device (scanner) 12, and the like.

The automatic document feeding device 11 conveys a document D placed on a document tray using a conveyance mechanism, and sends the document D to the document image scanning device 12. By using the automatic document feeding device 11, images of a large number of documents D (including both-sided images) placed on the document tray can be sequentially read all at once.

The document image scanning device 12 optically scans the document conveyed on a contact glass from the automatic document feeding device 11 or the document placed on the contact glass, forms an image of the light reflected from the document on a light receiving surface of a charge coupled device (CCD) sensor 12*a*, and reads the document image. The image reading unit 10 generates input image data on the basis of a reading result acquired by the document image scanning device 12. Predetermined image processing is applied to the input image data by the image processing unit 30.

As illustrated in FIG. 2, the operation display unit 20 includes, for example, a liquid crystal display (LCD) provided with a touch panel, and functions as a display unit 21 and an operation unit 22. The display unit 21 displays various operation screens, image states, operation states of each function, and the like in accordance with a display control signal input from the control unit 101. The operation unit 22 includes various operation keys such as a numeric keypad and a start key, receives various input operations made by a user, and outputs an operation signal to the control unit 101.

The image processing unit 30 includes a circuit or the like for performing digital image processing, which corresponds to an initial setting or a user setting, on the input image data. For example, under the control of the control unit 101, the image processing unit 30 performs gradation correction on the basis of gradation correction data (gradation correction table). In addition to the gradation correction, the image processing unit 30 performs, on the input image data, various correction processing such as color correction and shading correction, compression processing, and the like. The image forming unit 40 is controlled on the basis of the image data to which such processing has been applied.

As illustrated in FIG. 1, the image forming unit 40 includes image forming units 41Y, 41M, 41C, 41K for forming, on the basis of the input image data, images made of respective color toners of a component Y, a component M, a component C, and a component K, an intermediate transfer unit 42, and the like.

The image forming units 41Y, 41M, 41C, and 41K directed to the component Y, the component M, the component C, and the component K have similar configurations. For convenience of illustration and explanation, the same constituent elements are denoted by the same reference numerals. The letters Y, M, C, or K is added to the reference numerals when each of the numerals is distinguished. In FIG. 1, only the constituent elements of the image forming unit 41Y directed to the component Y are denoted by reference numerals. Reference numerals for the constituent elements of other image forming units 41M, 41C, and 41K are omitted.

The image forming unit 41 includes an exposure device 411, a developing device 412, a photosensitive drum 413, a charging device 414, a drum cleaning device 415, and the like.

The photosensitive drum 413 is formed of, for example, an organic photoreceptor in which a photosensitive layer made of a resin containing an organic photoconductor is formed on an outer peripheral surface of a drum-shaped metal substrate.

The control unit 101 controls drive current supplied to a drive motor (not illustrated) for rotating the photosensitive drum 413, thereby rotating the photosensitive drum 413 at a constant peripheral speed.

The charging device 414 is, for example, an electrifying charger, and generates corona discharge so that the surface of the photosensitive drum 413, which is photoconductive, is uniformly charged to a negative polarity.

The exposure device 411 is formed of, for example, a semiconductor laser, and irradiates the photosensitive drum 413 with laser beams corresponding to the images of respective color components. As a result, electrostatic latent images of respective color components are formed on an image area within the surface of the photosensitive drum 413, which is irradiated with the laser beam, due to a potential difference from a background area.

The developing device 412 is a developing device using a method of two-component reverse rotation development, and visualizes the electrostatic latent image by attaching a developer of each color component on the surface of the photosensitive drum 413 to form a toner image.

A DC developing bias having the same polarity as a charge polarity of the charging device 414 or a developing bias in which a DC voltage having the same polarity as the charge polarity of the charging device 414 is superposed on an AC voltage, for example, is applied to the developing device 412. As a result, a reversal development is performed in which toner is attached to the electrostatic latent image formed by the exposure device 411.

The drum cleaning device 415 abuts the surface of the photosensitive drum 413, includes a planar drum cleaning blade or the like formed of an elastic body, and removes toner remaining on the surface of the photosensitive drum 413 without being transferred to the intermediate transfer belt 421.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 is formed of an endless belt, and is stretched in a loop shape around the plurality of support rollers 423. At least one of the plurality of support rollers 423 is formed of a drive roller, and the others are formed of driven rollers. For example, a roller 423A disposed at, in the traveling direction of the belt, a downstream side of the primary transfer roller 422 directed to the component K, is preferably the drive roller. With this configuration, a traveling speed of the belt at the primary transfer portion can be easily maintained constant. As the drive roller 423A rotates, the intermediate transfer belt 421 travels at a constant speed in the direction indicated by the arrow A.

The intermediate transfer belt 421 is a conductive and elastic belt, and includes a high resistance layer provided on a surface thereof. The intermediate transfer belt 421 is rotationally driven by a control signal from the control unit 101.

The primary transfer roller 422 is disposed on the inner peripheral surface of the intermediate transfer belt 421 while facing the photosensitive drum 413 of each color component. The primary transfer roller 422 is pressed against the photosensitive drum 413 with the intermediate transfer belt 421 interposed therebetween, whereby a primary transfer nip for transferring the toner image from the photosensitive drum 413 to the intermediate transfer belt 421 is formed.

The secondary transfer roller 424 is disposed on the outer peripheral surface of the intermediate transfer belt 421 while facing a backup roller 423B disposed on, in the traveling direction of the belt, the downstream side of the drive roller 423A. The secondary transfer roller 424 is pressed against the backup roller 423B with the intermediate transfer belt 421 interposed therebetween, whereby a secondary transfer nip for transferring the toner image from the intermediate transfer belt 421 to the paper sheet S is formed.

When the intermediate transfer belt 421 passes through the primary transfer nip, the toner images on the photosensitive drum 413 are sequentially superposed and primarily transferred onto the intermediate transfer belt 421. Specifically, a primary transfer bias is applied to the primary transfer roller 422 and a charge having a polarity opposite to that of the toner is imparted to the back side of the intermediate transfer belt 421, that is, the side in contact with the primary transfer roller 422, whereby the toner image is electrostatically transferred onto the intermediate transfer belt 421.

Subsequently, when the paper sheet S passes through the secondary transfer nip, the toner image on the intermediate transfer belt 421 is secondarily transferred onto the paper sheet S. Specifically, a secondary transfer bias is applied to the secondary transfer roller 424 and the charge having the polarity opposite to that of the toner is imparted to the back side of the paper sheet S, that is, the side in contact with the secondary transfer roller 424, whereby the toner image is electrostatically transferred onto the paper sheet S. The paper sheet S onto which the toner image has been transferred is conveyed toward the fixing unit 60.

The belt cleaning device 426 removes residual toner particles remaining on the surface of the intermediate transfer belt 421 after the secondary transfer.

The fixing unit 60 includes an upper fixing unit 60A in which a fixing-surface-side member is disposed on the side of a fixing surface of the paper sheet S, that is, the side where the toner image is formed, and a lower fixing unit 60B in which a back-surface-side support member is disposed on the back side of the fixing surface of the paper sheet S, that is, the side opposite to the side where the toner image is formed. The back-surface-side support member is pressed against the fixing-surface-side member, whereby a fixing nip that sandwiches and conveys the paper sheet S is formed.

In the fixing unit 60, the toner image is secondarily transferred, and the paper sheet S having been conveyed is heated and pressurized at the fixing nip, whereby the toner image is fixed onto the paper sheet S. The fixing unit 60 is disposed inside a fuser F as a unit.

The upper fixing unit 60A includes an endless fixing belt 61 that is the fixing-surface-side member, a heat source 62, a pad member 63, a support member 69, and the like. The heat source 62, the pad member 63, and the support member 69 are placed inside the fixing belt 61.

The fixing belt 61 is formed in such a manner that, for example, an outer diameter thereof is 30 mm, a base layer made of polyimide, an elastic layer made of silicone rubber, and a surface layer made of fluororesin are laminated, and a total thickness thereof is 250 μm. In addition, a thermal conductivity in an in-plane direction of the fixing belt 61 is, for example, 0.8 W/(m•K).

Figure 3:
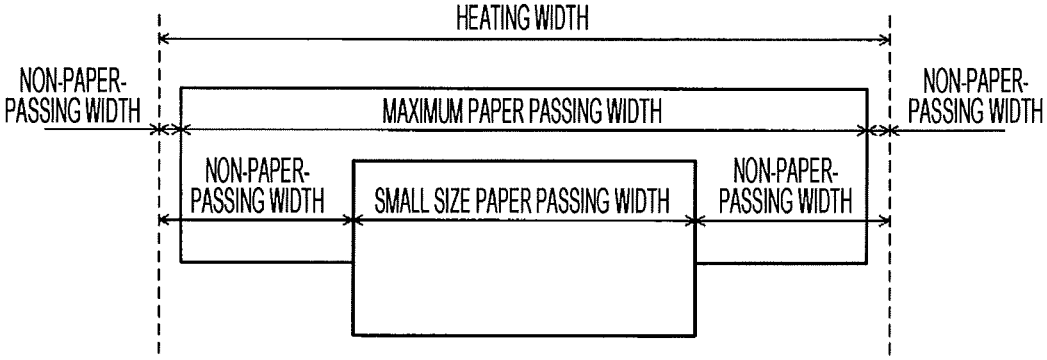
FIG. 3 is a diagram illustrating a relationship between a paper passing width and a heating width.

The heat source 62 is a halogen heater disposed inside the fixing belt 61. As illustrated in FIG. 3, a heating width of the heat source 62 is slightly wider than a maximum paper passing width of the image forming apparatus 1. For example, when the maximum paper passing width is 297 mm (A4Y size), the heating width is 340 mm, and a non-paper-passing width, which is a width of an area of each end portion where no paper sheet passes, is 21.5 mm. Further, in a case of a small size paper sheet S (AST size paper sheet having a paper passing width of 148.5 mm, for example), the non-paper-passing width is 95.75 mm.

As illustrated in FIG. 1, the pad member 63 presses the fixing belt 61 toward a pressure roller 64, whereby the fixing nip is formed between the pad member 63 and the pressure roller 64. The pad member 63 is formed of, for example, a polycarbonate material having a width of 12 mm and a length in an axial direction of 340 mm.

The support member 69 supports the pad member 63, and prevents deformation of the pad member 63 caused by pressurizing force from the pressure roller 64. The support member 69 is made of metal and is fixed inside the fuser F.

The lower fixing unit 60B includes the pressure roller 64 that is the back-surface-side support member. The pressure roller 64 and the fixing belt 61 form the fixing nip that sandwiches and conveys the paper sheet S therebetween. The pressure roller 64 corresponds to a "pressure member" of the present invention.

The pressure roller 64 may be the one having an outer diameter of 25 mm, a hardness of 50 degrees in JIS-A hardness, and a thickness of each of an elastic layer made of silicone material and a surface layer made of fluororesin of 4 mm. Further, the pressure roller 64 is pressed toward the pad member 63 by a spring (not illustrated) with the force of 300 N through the fixing belt 61 so that the elastic layer and the surface layer are crushed, whereby the fixing nip of about 8 mm is formed.

The paper conveying unit 50 includes a paper feed unit 51, a paper discharge unit 52, a conveying path 53, and the like. In the three paper feed tray units 51*a* to 51*c* included in the paper feed unit 51, paper sheets S (standard paper or special paper) discriminated on the basis of weight, size, and the like are stored for each preset type. The conveying path 53 includes a plurality of conveyance roller pairs including a registration roller pair 53*a*. A registration roller portion in which the registration roller pair 53*a* is disposed corrects an inclination and deviation of the paper sheet S.

The paper sheets S stored in the paper feed tray units 51*a* to 51*c* are sent out from the uppermost portion one by one and conveyed to the image forming unit 40 through the conveying path 53. In the image forming unit 40, the toner image on the intermediate transfer belt 421 is secondarily transferred onto one side of the paper sheet S collectively, and is subject to a fixing process in the fixing unit 60. The paper sheet S on which the image has been formed is discharged outside the apparatus by the paper discharge unit 52 including a paper discharge roller 52*a*.

Figure 4:
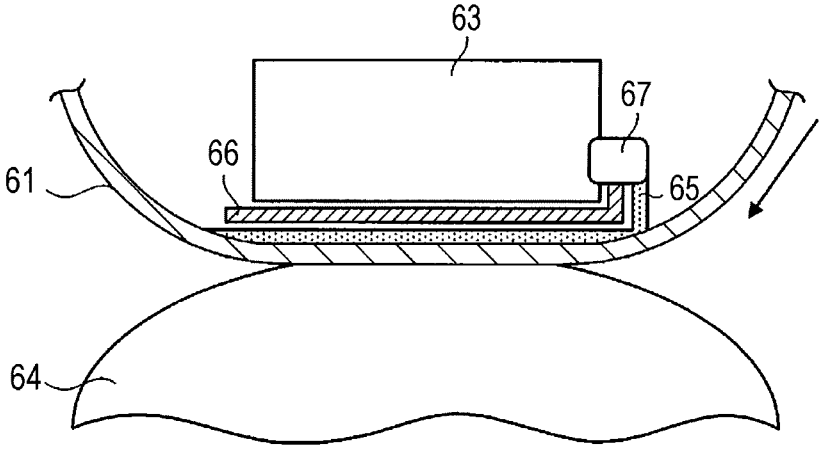
FIG. 4 is a view illustrating a fixing nip portion of a fixing unit.

In the present embodiment, as illustrated in FIG. 4, a friction reducing sheet 65 and a heat equalizing sheet 66, which are flexible, are provided between the fixing belt 61 and the pad member 63.

The friction reducing sheet 65 is a sliding sheet for reducing frictional resistance between the pad member 63 and the fixing belt 61. The friction reducing sheet 65 is formed in such a manner that a surface layer of a base material made of glass fibers having a woven fabric structure or the like is coated with a fluorine-based resin such as PTFE or PFA. Further, the friction reducing sheet 65 may be formed in such a manner that unevenness is formed on the surface layer of the base material, which is a sheet made of PTFE, by applying embossing treatment or the like.

When the fixing unit 60 using a fixing pad is used, there may be a problem that torque increases by frictional resistance between the inner peripheral surface of the fixing belt 61 and the pad member 63.

When the torque increases, problems of an increase in size of a drive motor and an increase in power consumption are likely to occur. Moreover, the surface of the pressure roller 64 to be rotationally driven and the surface of the fixing belt 61 to be rotated following the pressure roller 64 rub against each other, whereby wear and deterioration of the pressure roller 64 and the fixing belt 61 may be accelerated.

In view of the above, by providing the friction reducing sheet 65 between the pad member 63 and the fixing belt 61, the frictional resistance is reduced, whereby the occurrence of the above-described problem of the torque increase can be suppressed.

The heat equalizing sheet 66 is provided between the friction reducing sheet 65 and the pad member 63, and uniformizes the fixing belt 61 at the fixing nip in the width direction of the paper sheet passing through the fixing nip.

While the inside of a paper-passing area within the fixing nip is controlled such that a temperature thereof becomes a fixing temperature (about 160° C.), the non-paper-passing area within the fixing nip is not deprived of heat by the passing paper sheet S and is not cooled, whereby the temperature of the non-paper-passing area may become higher than the fixing temperature. When a maximum size paper sheet S passes, the non-paper-passing width of the non-paper-passing area is as narrow as 21.5 mm as described above, and a heat radiation amount increases since the non-paper-passing area is the endmost portion in the axial direction. Accordingly, the temperature of the non-paper-passing area within the fixing nip is lower than that of the paper-passing area by about 5° C., for example, whereby the temperature of the non-paper-passing area does not rise too much.

However, when the small size paper sheet S (AST size of 148.5 mm, for example) passes, the non-paper-passing width of the non-paper-passing area is 95.75 mm. In this area, the non-paper-passing width is significantly wider than that in the case of the maximum size paper sheet S, whereby the temperature of the non-paper-passing area within the fixing nip is likely to increase.

In addition, since the friction reducing sheet 65 is commonly made of a fluorine-based resin material, there is a disadvantage that the thermal conductivity is low. When the friction reducing sheet 65 is disposed, a heat transfer amount in the axial direction across the fixing nip is significantly small. Therefore, when the small size paper sheet S passes through the fixing nip, for example, a problem of a remarkable temperature increase in the non-paper-passing area within the fixing nip is likely to occur. Specifically, when the fixing temperature is 160° C., the temperature of the non-paper-passing area may exceed 250° C. at times. As a consequence, each member such as the fixing belt 61 may be destroyed by heat.

In contrast, in the present embodiment, the temperature in the fixing nip is equalized by the heat equalizing sheet 66, whereby destruction of each member due to the temperature increase in the non-paper-passing area can be suppressed.

Figure 5:
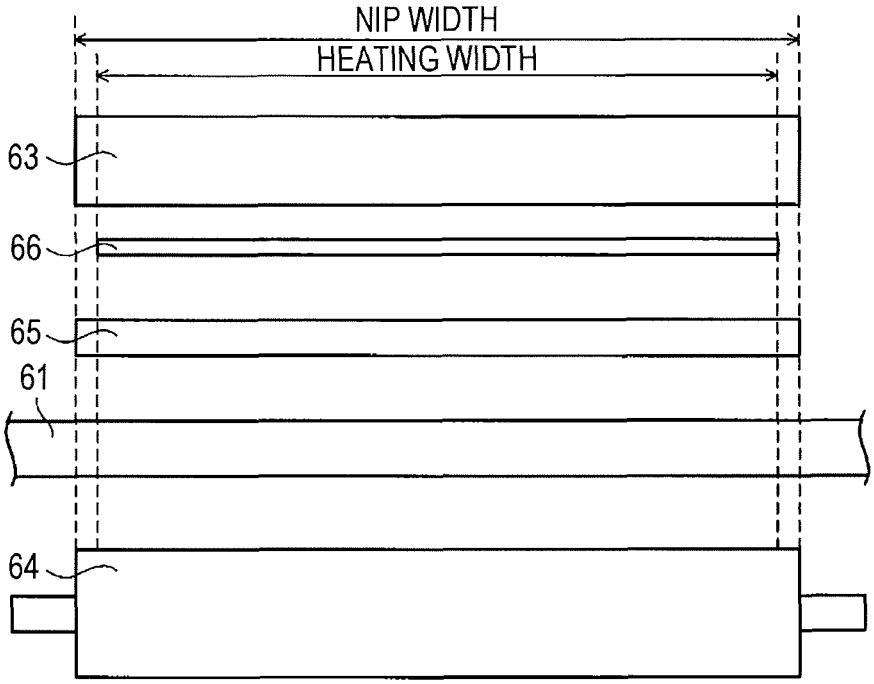
FIG. 5 is a view for comparing widths of respective members.

The heat equalizing sheet 66 is formed in such a manner that the width thereof in the axial direction is constant in a rotational direction of the fixing belt 61, and the thickness thereof is also constant throughout the sheet. As illustrated in FIG. 5, the width of the heat equalizing sheet 66 is set to be the same as the heating width. As a result, the entire fixing nip can be effectively heated uniformly.

Further, a width of the friction reducing sheet 65 is set to be wider than that of the heat equalizing sheet 66, and also to be equal to a width of the pad member 63 and the pressure roller 64, that is, a nip width of the fixing nip.

With this configuration, a fixing nip portion to which a load is applied can be covered with the friction reducing sheet 65, whereby the frictional resistance caused by the pressure application between the pad member 63 and the pressure roller 64 can be effectively reduced. As a result, the torque caused by the rotational drive of the fixing belt 61 can be kept at a low level. The width of the friction reducing sheet 65 may be wider than that of the pad member 63 and the pressure roller 64.

As described above, since the friction reducing sheet 65 and the heat equalizing sheet 66 are flexible, the friction reducing sheet 65 and the heat equalizing sheet 66 conform to a shape of the fixing nip without counteracting pressurizing force from the pad member 63 and the pressure roller 64. Since the temperature of the fixing nip becomes high, the shape of the fixing nip conforms to a shape of the pad member 63 without being subject to deformation such as twisting or bending even in a case where there is a difference in a thermal expansion amount among the friction reducing sheet 65, the heat equalizing sheet 66, and the pad member 63.

Figure 6:
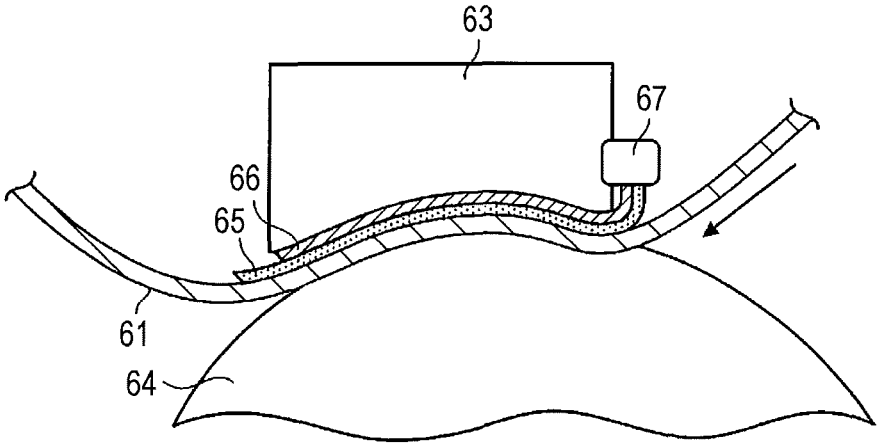
FIG. 6 is a view illustrating a fixing nip portion in a case where a concave pad member is used.

The pad member 63 may have a round surface conforming to a shape of the pressure roller 64 at times, as illustrated in FIG. 6, whereby the shape of the fixing nip is often a concave shape in many cases. For example, when a solid heat equalizing member is used for such a shape of the fixing nip, the heat equalizing member is difficult to dispose in conformity with the shape of the pad member 63, whereby the shape of the fixing nip varies and the width of the fixing nip becomes non-uniform.

Meanwhile, when the flexible heat equalizing sheet 66 is used, the shape thereof smoothly conforms to the shape of the pad member 63 so that the width of the fixing nip can be made uniform.

From the viewpoint of reliably maintaining the flexibility of the sheet, the thickness of the friction reducing sheet 65 and the heat equalizing sheet 66 is preferably 200 μm or less. In the case where metal is used as the heat equalizing sheet 66, the thickness of the heat equalizing sheet 66 is preferably 100 μm or less.

Moreover, the thermal conductivity of the heat equalizing sheet 66 is higher than that of the friction reducing sheet 65, and in view of achieving high thermal conduction, the thermal conductivity of the heat equalizing sheet 66 is preferably at least 200 W/(m•K). While examples of such a heat equalizing sheet 66 include carbon fibers, copper, and graphite, from the viewpoint of the highest thermal conductivity included therein, graphite is preferably used as the material of the heat equalizing sheet 66.

Since some graphite has a thermal conductivity of 1000 W/(m•K) or more, even in a case where the thickness is 100 μm or less, a sufficient heat equalizing function can be exerted. As a result, the flexibility as the heat equalizing sheet 66 can be exerted and a thermal capacity can be kept low, whereby energy saving can be also achieved.

Graphite is characterized in that the thinner the thickness thereof becomes, the higher the in-plane thermal conductivity thereof becomes. Accordingly, in order to exert a high thermal conductance, for example, a higher thermal conductance in the in-plane direction is exerted when a plurality of (for example, four) thin graphite sheets having a thickness of 20 μm, for example, is used in a stacked state rather than using one graphite sheet having a thickness of 100 μm. Therefore, by disposing a plurality of stacked graphite heat equalizing sheets 66, a heat equalizing effect can be further enhanced.

Further, when the plurality of heat equalizing sheets 66 is stacked, the heat equalizing sheets 66 adjoining one another may be used as one stacked graphite sheet by bonding the heat equalizing sheets together using, for example, an adhesive having a thermal conductivity of about 2 W/(m•K) or an ultrathin double-sided tape having a thickness of about 10 μm.

Figure 7:
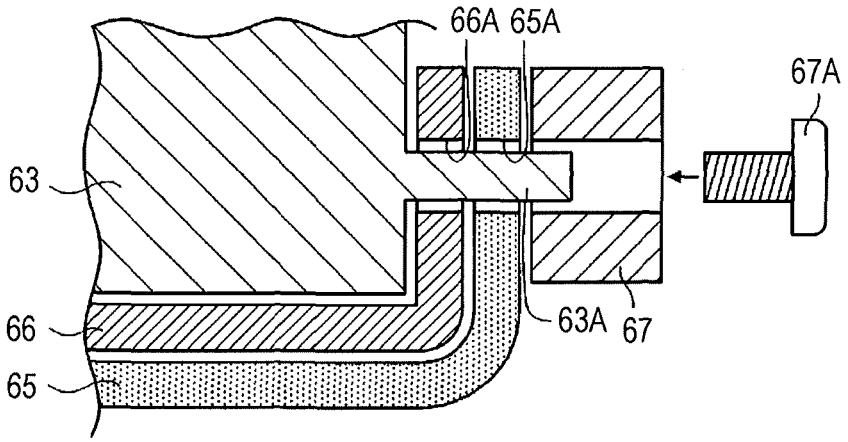
FIG. 7 is an enlarged view of a securing portion where a pad member, a friction reducing sheet, and a heat equalizing sheet are secured.

Furthermore, as illustrated in FIG. 7, the friction reducing sheet 65 and the heat equalizing sheet 66 are fixed at a position other than the fixing nip. Specifically, the friction reducing sheet 65 and the heat equalizing sheet 66 are fixed to a side end portion of the pad member 63, which is on an upstream side in the rotational direction of the fixing belt 61.

Fixing holes 65A and 66A are formed at the end portion of the friction reducing sheet 65 and the heat equalizing sheet 66, which is on the upstream side in the rotational direction. A fixing shaft 63A is formed at the side end portion of the pad member 63, which is on the upstream side in the rotational direction. A plurality of the fixing holes 65A and 66A and the fixing shaft 63A are formed side by side in the axial direction.

The fixing shaft 63A is inserted into the fixing holes 65A and 66A, whereby the friction reducing sheet 65 and the heat equalizing sheet 66 are fixed. Specifically, a fixing member 67 into which the fixing shaft 63A can be inserted presses the friction reducing sheet 65 and the heat equalizing sheet 66 from above, whereby the friction reducing sheet 65 and the heat equalizing sheet 66 are fixed. The fixing member 67 is secured by, for example, a screw 67A.

In this manner, since the friction reducing sheet 65 and the heat equalizing sheet 66 are fixed at the portion other than the fixing nip, even in a case where the friction reducing sheet 65 and the heat equalizing sheet 66 thermally expand or elongation occurs due to shearing force caused by sliding friction, generation of non-uniform portions such as wrinkles can be suppressed.

Moreover, since the plurality of fixing holes 65A and 66A and the fixing shaft 63A are formed, even in a case where strong shearing force acts on the friction reducing sheet 65 and the heat equalizing sheet 66, shifting of the friction reducing sheet 65 and the heat equalizing sheet 66 can be suppressed.

The frictional resistance in the fixing nip may become large in some cases, such as a case where the load of the pressure roller 64 is large (500 N, for example), or a case where a friction coefficient of the friction reducing sheet 65 is large (0.25, for example). In such a case, the friction reducing sheet 65 is pulled at the fixing nip portion so that the fixing holes 65A and 66A are expanded, thereby causing a problem that the friction reducing sheet 65 and the heat equalizing sheet 66 may be broken.

In contrast, in the present embodiment, the friction reducing sheet 65 and the heat equalizing sheet 66 are pressed by the fixing member 67, thereby suppressing the phenomenon in which the fixing holes 65A and 66A expand or the heat equalizing sheet 66 breaks.

Moreover, each end portion of the friction reducing sheet 65 and the heat equalizing sheet 66, which is on the downstream side in the rotational direction, may be a free end. That is, at least one of the friction reducing sheet 65 and the heat equalizing sheet 66 may include a fixed end fixed on the upstream side of the fixing nip in the rotational direction of the fixing belt 61, and a free end not fixed on the downstream side of the fixing nip. With this configuration, the friction reducing sheet 65 and the heat equalizing sheet 66 can smoothly follow the rotation of the fixing belt 61 since the downstream end thereof is not fixed.

However, when it is necessary to fix the end portion on the downstream side in consideration of the assembly efficiency, the end portion may be fixed via an elastic member, or may be fixed in such a manner that the friction reducing sheet 65 and the heat equalizing sheet 66 are slackened.

Figure 8:
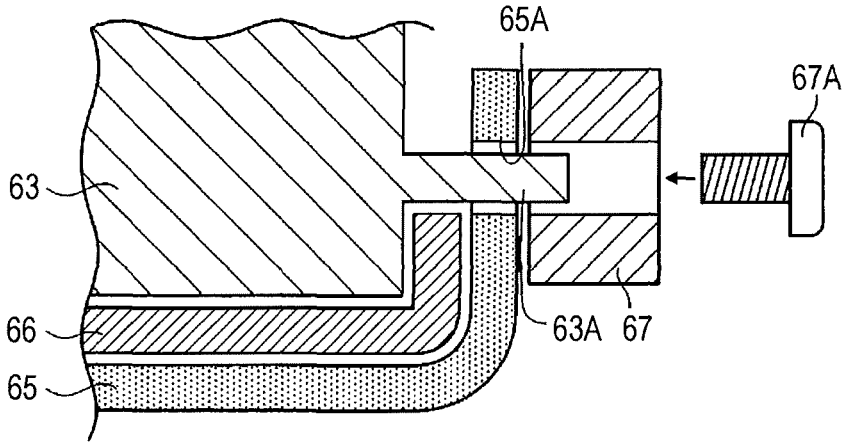
FIG. 8 is an enlarged view of a securing portion according to a variation where a pad member, a friction reducing sheet, and a heat equalizing sheet are secured.

In addition, since the heat equalizing sheet 66 is not in contact with the fixing belt 61, strong shearing force is not applied thereto. Accordingly, as illustrated in FIG. 8, the heat equalizing sheet 66 may be fixed to the side end portion on the upstream side of the pad member 63 using only a heat resistant adhesive. The fixing member 67 may not be provided in the configurations illustrated in FIGS. 7 and 8.

Figure 9:
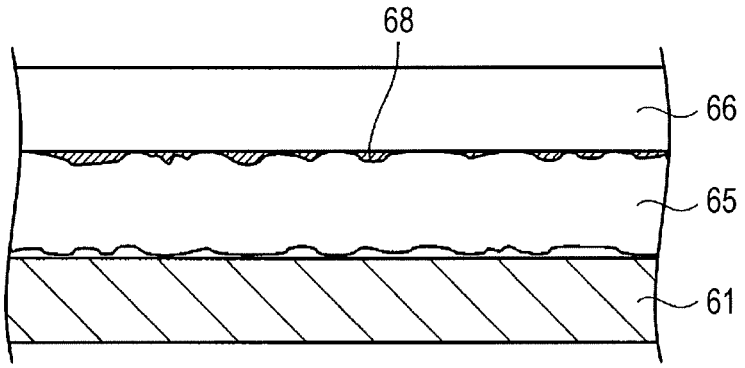
FIG. 9 is an enlarged view of a portion where a heat transfer member is inserted between the heat equalizing sheet and the friction reducing sheet.

Incidentally, as illustrated in FIG. 9, the friction coefficient of the friction reducing sheet 65 is set low (about $\mu \leq 0.18$, for example) by its surface state being irregularly formed. On the other hand, since the heat equalizing sheet 66 is copper, graphite, or the like having the high thermal conductivity, the surface thereof is substantially smooth and the friction coefficient is larger than that of the friction reducing sheet 65. Accordingly, when the friction reducing sheet 65 and the heat equalizing sheet 66 are stacked with each other, gaps are left on the contact portion therebetween due to the influence of the irregularity of the friction reducing sheet 65, thereby hindering the thermal conduction in the heat equalizing sheet 66.

In view of the above, a viscous or elastic heat transfer member 68 is preferably inserted between the heat equalizing sheet 66 and the friction reducing sheet 65. Examples of the heat transfer member 68 include a grease material, an adhesive material, a rubber material, and a phase change material, which have a thermal conductivity of 1 W/(m•K) or more. Examples of the phase change material include Phase Change Material "PCS-LT-30" manufactured by Shin-Etsu Chemical Co., Ltd.

Figure 10:
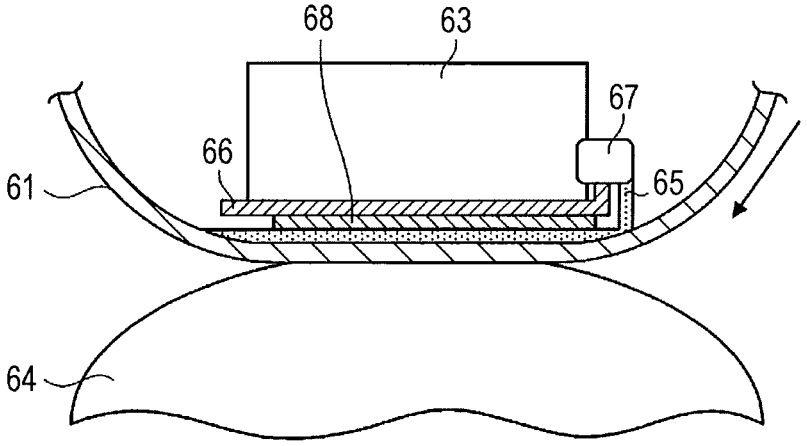
FIG. 10 is a view simply illustrating a fixing nip portion of the configuration in which the heat transfer member is inserted between the heat equalizing sheet and the friction reducing sheet.

The viscous or elastic heat transfer member 68 mentioned above is crushed and spread by the load applied to the fixing nip such that the heat transfer member 68 spreads over even small gaps, whereby air layers in the gaps can be removed. When the air layers are removed, as illustrated in FIG. 10, for example, the friction reducing sheet 65 and the heat equalizing sheet 66 are in close contact with each other with the heat transfer member 68 interposed therebetween, whereby the thermal conduction between the friction reducing sheet 65 and the heat equalizing sheet 66 is improved and the heat equalizing function can be further improved.

In addition, the pad member 63 is preferably formed of a thermal insulating material made of resin. When the thermal conductivity of the pad member 63 is high (thermal conductivity≥50 W/(m•K), for example), the heat of the fixing belt 61 flows into the pad member 63 in the fixing nip. In other words, since the thermal capacity in the fixing nip increases, the temperature of the fixing belt 61 in the fixing nip hardly increases. Accordingly, the pad member 63 needs to be formed of a material having an excellent heat insulating property. In addition, the thermal conduction and the strength can be balanced by supporting the pad member 63 with the highly rigid metal support member 69, thereby securing the strength.

Figure 11:
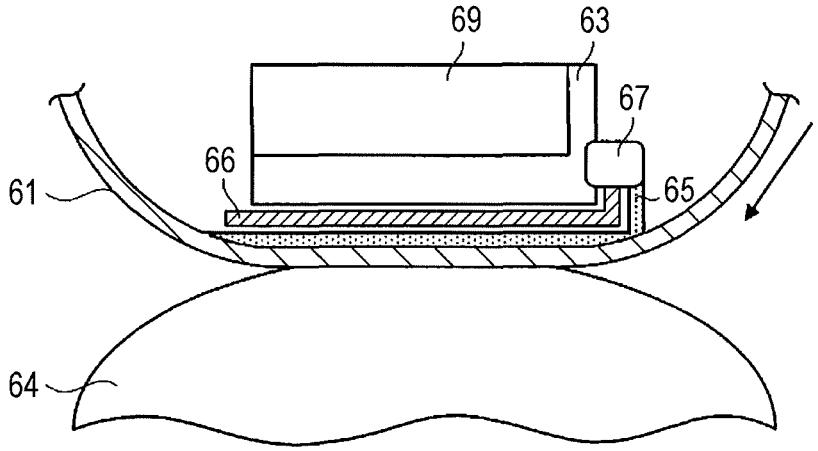
FIG. 11 is a view illustrating a fixing nip portion according to a variation where a heat insulating property of a pad member is considered.

However, when the support member 69 and the heat equalizing sheet 66 are brought into contact with each other, the heat of the fixing belt 61 is transmitted to the support member 69 via the heat equalizing sheet 66 accordingly, whereby the heat insulating property of the pad member 63 cannot be exerted. In view of the above, the pad member 63 is preferably formed in such a manner that the support member 69 and the heat equalizing sheet 66 are not in contact with each other. For example, as illustrated in FIG. 11, a securing portion where the heat equalizing sheet 66 is secured may be formed on the pad member 63.

According to the present embodiment having the above-described configuration, the friction reducing sheet 65 and the heat equalizing sheet 66 are disposed between the fixing belt 61 and the pad member 63, whereby the thermal uniformity and the slidability in the fixing nip can be improved while the width of the fixing nip is kept uniform.

Moreover, since the friction reducing sheet 65 and the heat equalizing sheet 66 are both in the sheet shape, the configuration can be simplified, thereby contributing to size reduction, cost reduction, and improvement of an energy saving effect of the apparatus as a whole.

Although the heat source 62 is disposed inside the fixing belt 61 in the above-described embodiment, the present invention is not limited thereto, and the heat source 62 may be disposed outside the fixing belt 61. However, the heat source 62 is preferably disposed inside the fixing belt 61 from the viewpoint that the heat equalizing effect of the heat equalizing sheet 66 can be enhanced in a case where the temperature of the inner peripheral surface of the fixing belt 61 is made higher than that of the outer peripheral surface of the fixing belt 61.

Figure 12:
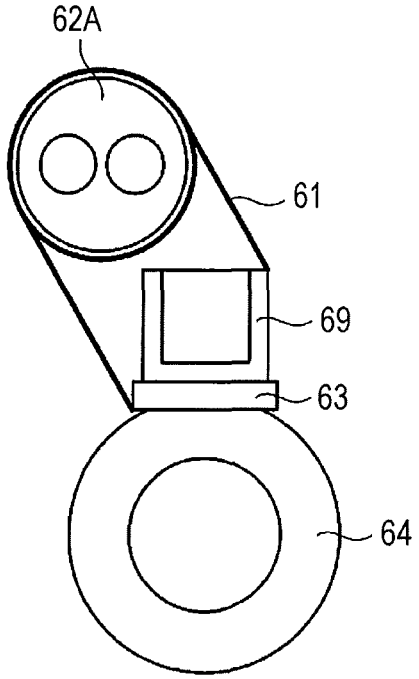
FIG. 12 is a view illustrating a fixing unit provided with a heating roller.

Moreover, although the heat source (halogen heater) 62 disposed inside the fixing belt 61 exemplifies a heating member in the above-described embodiment, the present invention is not limited thereto. For example, as illustrated in FIG. 12, a configuration in which the fixing belt 61 is stretched between a heating roller 62A, which includes a heating member, and the pad member 63 may be employed. In addition, a heating method may be any one of those using IH, a resistance heating element, or a heater lamp.

Furthermore, the above-described embodiment is illustrative only for embodying the present invention, and the technical scope of the present invention should not be construed to be restrictive thereby. In other words, the present invention can be implemented in various forms without departing from the gist or main features thereof.

Finally, an evaluation experiment with respect to the fixing unit 60 according to the present embodiment will be described. The experiment was conducted under an experimental environment with a temperature of 23° C. and a relative humidity of 65%. As the fixing unit 60, the one having a diameter of the inner peripheral surface of the fixing belt 61 of 30 mm, an entire length of the fixing belt 61 of 350 mm, and a heating area length of 300 mm was used.

As the friction reducing sheet 65, the one made of glass fibers having a surface coated with fluorine was used. A paper passing condition was set such that a controlled temperature was 150° C., a paper basis weight was 90 g/m$^2$, and a conveying speed was 20 sheets per minute for AST size paper sheets.

In a first experiment, the effect exerted by the heat equalizing sheet 66 formed of a material having a thermal conductivity of 200 W/(m•K) or more and a thickness of 200 μm or less was confirmed.

As the heat equalizing sheet 66, those made of stainless steel, aluminum, copper, and graphite were used. With respect to dimensions of the heat equalizing sheet 66, those having lengths of 320 mm, a width of 10 mm, and a thickness of 100 μm, 200 μm, and 400 μm were used.

First, in a state where the fixing unit 60 was rotationally driven, a heat-up time until reaching the controlled temperature (150° C.) was measured while the heat source 62 was fully lit. With respect to an experimental method, while aluminum was employed as the heat equalizing sheet 66, the respective heat-up times from the temperature of 23° C. to 150° C. for respective thicknesses were measured.

Figure 13:
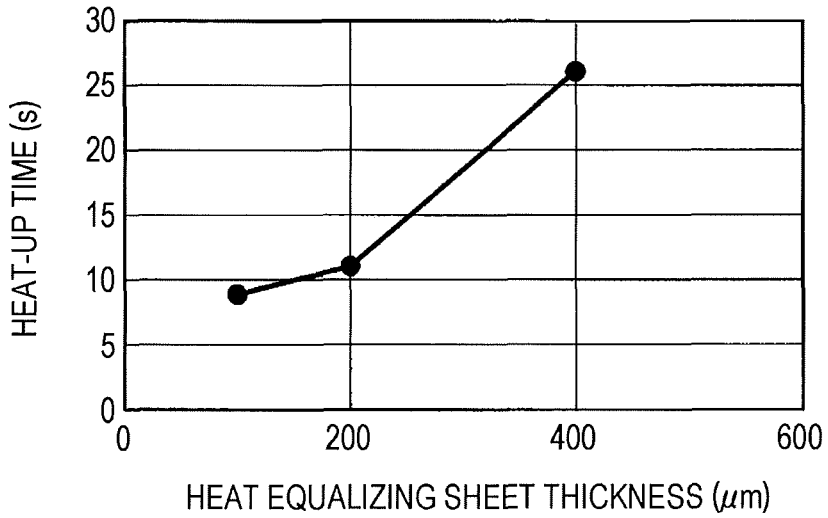
FIG. 13 is a chart illustrating a relationship between a thickness of the heat equalizing sheet and a heat-up time.

FIG. 13 is a chart illustrating a relationship between the thickness of the heat equalizing sheet 66 and the heat-up time. As illustrated in FIG. 13, it can be confirmed that the heat-up time increases after the thickness of the heat equalizing sheet 66 exceeds about 200 μm. That is, when the thickness of the heat equalizing sheet 66 exceeds 200 μm, the thermal capacity increases so that the temperature hardly increases, whereby it was confirmed that the thickness of the heat equalizing sheet 66 is preferably 200 μm or less.

Next, a surface temperature of the fixing belt 61 was measured using thermography in a case where a temperature of the end portion of the fixing belt 61 was saturated to a constant temperature at the time of feeding a small size paper sheet. With respect to an experimental method, the temperature of the end portion of the fixing belt 61 was measured while the thermal conductivity of the heat equalizing sheet 66 and the thickness of the heat equalizing sheet 66 were varied.

Figure 14:
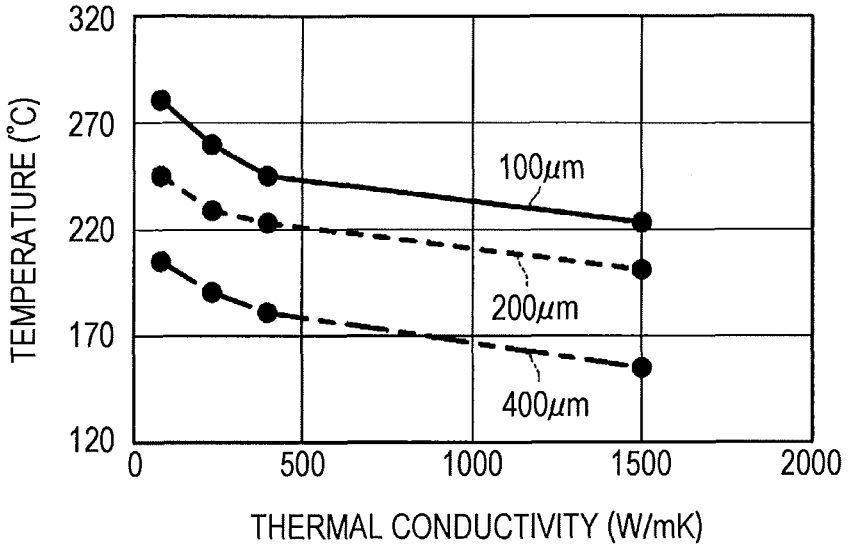
FIG. 14 is a chart illustrating a relationship between a thermal conductivity of the heat equalizing sheet and a temperature of an end portion of a fixing belt.

FIG. 14 is a chart illustrating a relationship between the thermal conductivity of the heat equalizing sheet 66 and the temperature of the end portion of the fixing belt 61. As illustrated in FIG. 14, it can be confirmed that, when the thermal conductivity of the heat equalizing sheet 66 becomes smaller than 200 W/(m•K), the temperature of the end portion of the fixing belt 61 (hereinafter referred to as "end temperature") increases sharply in every heat equalizing sheet 66 different in thickness.

In contrast, it can be confirmed that, when the thermal conductivity of the heat equalizing sheet 66 becomes 200 W/(m•K) or more, the end temperature of the fixing belt 61 gradually decreases as the thermal conductivity increases. In other words, in consideration of the end temperature of the fixing belt 61 not increased too much, it was confirmed that the thermal conductivity of the heat equalizing sheet 66 is preferably 200 W/(m•K) or more.

In order to suppress the temperature of the fixing belt 61 to less than about 230° C., which is a heat resistant temperature of the elastic layer (silicone rubber) of the fixing belt 61, the thermal conductivity of the heat equalizing sheet 66 should at least be increased, or the thickness of the heat equalizing sheet 66 should at least be increased.

Next, the end temperature of the fixing belt 61 was measured while the thickness of the heat equalizing sheet 66 was set to 200 μm and a material of the heat equalizing sheet 66 was varied among stainless steel, aluminum, copper, and graphite. Here, the thermal conductivity of stainless steel is 84 W/(m•K), the thermal conductivity of aluminum is 236 W/(m•K), the thermal conductivity of copper is 400 W/(m•K), and the thermal conductivity of graphite is 1500 W/(m•K).

Figure 15:
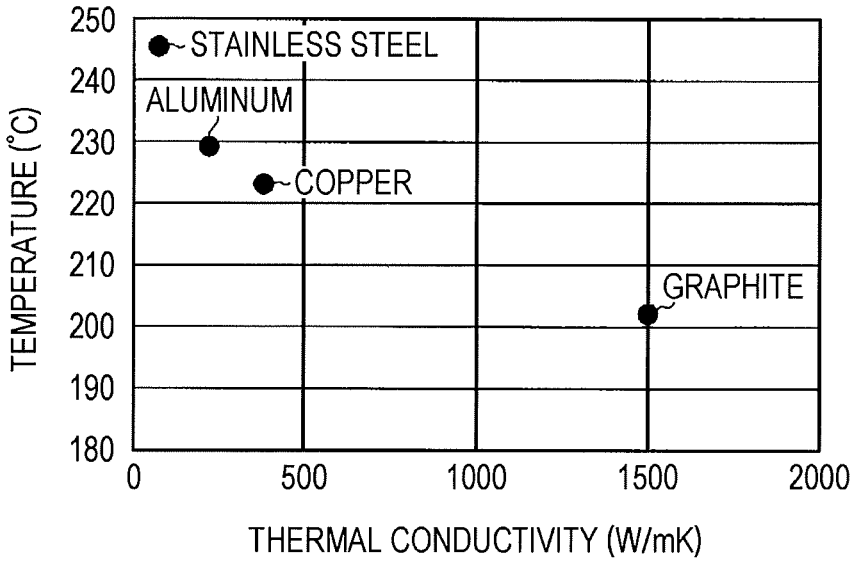
FIG. 15 is another chart illustrating the relationship between the thermal conductivity of the heat equalizing sheet and the temperature of the end portion of the fixing belt.

FIG. 15 is a chart illustrating the relationship between the thermal conductivity of the heat equalizing sheet 66 and the end temperature of the fixing belt 61. As illustrated in FIG. 15, when the material of the heat equalizing sheet 66 is stainless steel, the thermal conductivity is 84 W/(m•K) so that the end temperature of the fixing belt 61 exceeds 230° C. In contrast, it can be confirmed that, when aluminum, copper, or graphite is employed, the thermal conductivity exceeds 200 W/(m•K) and the end temperature of the fixing belt 61 can be suppressed to less than 230° C. In other words, it was confirmed that the thermal conductivity of the heat equalizing sheet 66 is preferably 200 W/(m•K) or more, and the thickness of the heat equalizing sheet 66 is preferably 200 μm or less.

In the first experiment, it was confirmed that no problem with regard to the heat-up time and the end temperature is caused when the material of the heat equalizing sheet 66 is aluminum. However, as a speed of processing performed by the image forming apparatus 1 is accelerated, it is predictable that electric power of the heat source 62 in the fixing unit 60 is increased, and eventually the end temperature of the fixing belt 61 becomes higher. In view of the above, it is preferable to employ copper or graphite as the material of the heat equalizing sheet 66 so that the increase in the end temperature can be suppressed while the heat-up time is maintained.

Next, in a second experiment, the effect exerted by the heat transfer member 68 having a thermal conductivity of 1 W/(m•K) or more was confirmed. As the heat transfer member 68, those having thermal conductivities of 0.8 W/(m•K), 1.4 W/(m•K), 2.6 W/(m•K), and 5.4 W/(m•K) were used.

With respect to the experimental method, the end temperature of the fixing belt 61 was measured while the thermal conductivity of the heat transfer member 68 was varied and a small size paper sheet was fed.

Figure 16:
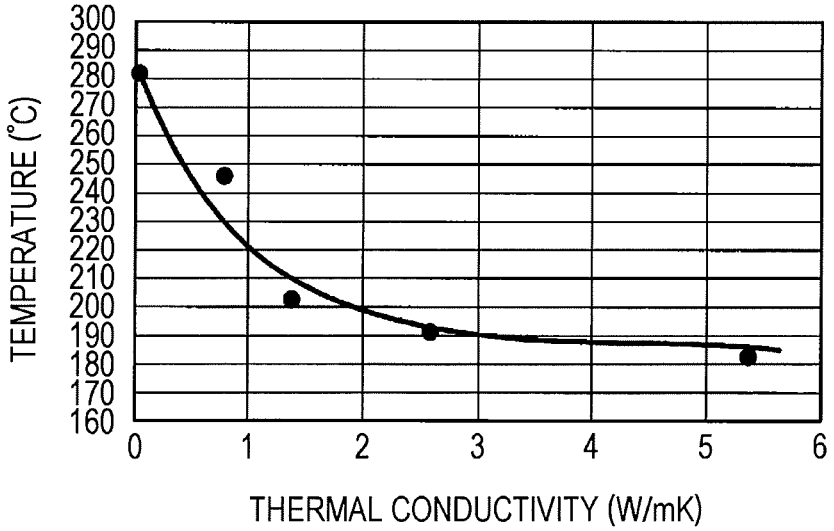
FIG. 16 is still another chart illustrating the relationship between the thermal conductivity of the heat equalizing sheet and the temperature of the end portion of the fixing belt.

FIG. 16 is a chart illustrating the relationship between the thermal conductivity of the heat equalizing sheet 66 and the end temperature of the fixing belt 61. As illustrated in FIG. 16, it can be confirmed that the end temperature of the fixing belt 61 increases to a temperature higher than 230° C. when the thermal conductivity of the heat transfer member 68 is 0.8 W/(m•K) or less. In contrast, it can be confirmed that the end temperature of the fixing belt 61 is less than 230° C. when the thermal conductivity of the heat transfer member 68 is 1.4 W/(m•K) or more. In other words, it was confirmed that the thermal conductivity of the heat transfer member 68 is preferably 1 W/(m•K) or more.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing device, comprising:

a fixing belt that is endless and rotatable;

a heating member that heats the fixing belt;

a pressure member that is rotatable and presses the fixing belt from outside;

a pad member that forms a fixing nip by sandwiching the fixing belt with the pressure member;

a support member that supports the pad member;

a friction reducing sheet that is provided between the fixing belt and the pad member and reduces friction with the fixing belt; and a heat equalizing sheet that is provided between the friction reducing sheet and the pad member and heats the fixing belt at the fixing nip uniformly in a width direction of a paper sheet passing through the fixing nip.

2. The fixing device according to claim 1, wherein the heating member is disposed inside the fixing belt.

3. The fixing device according to claim 1, further comprising:

a heating roller that includes the heating member and stretches the fixing belt together with the pad member.

4. The fixing device according to claim 1, wherein at least one of the friction reducing sheet and the heat equalizing sheet is fixed to the pad member or the support member on an upstream side of the fixing nip in a rotational direction of the fixing belt.

5. The fixing device according to claim 4, wherein at least one of the friction reducing sheet and the heat equalizing sheet includes a fixed end fixed on the upstream side of the fixing nip in the rotational direction of the fixing belt, and a free end not fixed on a downstream side of the fixing nip.

6. The fixing device according to claim 1, wherein the heat equalizing sheet has a thermal conductivity of 200 W/(m•K) or more and a thickness of 200 μm or less.

7. The fixing device according to claim 6, wherein a material of the heat equalizing sheet is graphite.

8. The fixing device according to claim 7, wherein a plurality of the heat equalizing sheets is provided in a stacked manner.

9. The fixing device according to claim 8, wherein the plurality of heat equalizing sheets is provided in such a manner that two adjoining heat equalizing sheets are bonded.

10. The fixing device according to claim 1, wherein the friction reducing sheet includes:

a base material having a woven fabric structure coated with a fluorine-based resin; or a base material to which unevenness processing is applied.

11. The fixing device according to claim 10, wherein an elastic or viscous heat transfer member is inserted between the friction reducing sheet and the heat equalizing sheet.

12. The fixing device according to claim 11, wherein a thermal conductivity of the heat transfer member is 1 W/(m•K) or more.

13. The fixing device according to claim 1, wherein the pad member is formed of a resin material, and the heat equalizing sheet is not in contact with the support member.

14. The fixing device according to claim 1, wherein a friction coefficient of the heat equalizing sheet is larger than a friction coefficient of the friction reducing sheet, and a thermal conductivity of the heat equalizing sheet is larger than a thermal conductivity of the friction reducing sheet.

15. An image forming apparatus, comprising:

the fixing device according to claim 1.

* * * * *